US008863961B2

(12) United States Patent
Carpenter et al.

(10) Patent No.: US 8,863,961 B2
(45) Date of Patent: Oct. 21, 2014

(54) METHOD AND SYSTEM OF SORTING ITEMS FOR DELIVERY TO A RECIPIENT

(75) Inventors: Michael D. Carpenter, Arlington, TX (US); James M. Pippin, Keller, TX (US); Dale Redford, Grand Prairie, TX (US); Floyd W. Worth, II, Richardson, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 1011 days.

(21) Appl. No.: 12/800,857

(22) Filed: May 26, 2010

(65) Prior Publication Data

US 2010/0300944 A1 Dec. 2, 2010

Related U.S. Application Data

(60) Provisional application No. 61/181,139, filed on May 26, 2009.

(51) Int. Cl.
*B07C 5/00* (2006.01)
*B07C 3/00* (2006.01)

(52) U.S. Cl.
CPC ..... *B07C 3/00* (2013.01)
USPC ..... 209/546; 209/630

(58) Field of Classification Search
USPC ..... 209/546, 549, 550, 551, 552, 630, 702
See application file for complete search history.

(56) References Cited

U.S. PATENT DOCUMENTS

| | | | | |
|---|---|---|---|---|
| 5,794,789 | A * | 8/1998 | Payson et al. | 209/549 |
| 7,516,848 | B1 * | 4/2009 | Shakes et al. | 209/34 |
| 2004/0011711 | A1 * | 1/2004 | Steinmetz et al. | 209/546 |

* cited by examiner

*Primary Examiner* — Joseph C Rodriguez
*Assistant Examiner* — Kalyanavenkateshware Kumar

(57) ABSTRACT

A system, method and apparatus for sorting items for delivery. A smart case module includes a plurality of bins. Each bin includes a display for a sort criteria for the bin and a first indicator to indicate that the bin is active. The bin also includes an input device for an operator to use to indicate that an item has been placed in the bin. The bin further includes a second indicator to indicate that the bin contains a sufficient number of items for a shipping container.

14 Claims, 13 Drawing Sheets

Front
Side
Back
10
12
22
23
14
16
28
18
19
20
24
26
29
BE
061-220

METHOD AND SYSTEM OF SORTING ITEMS FOR DELIVERY TO A RECIPIENT

This application claims priority of U.S. Provisional Application No. 61/181,139, filed May 26, 2009.

FIELD OF THE INVENTION

This invention relates to a method and system for sorting and transporting flat items such as letters and flats.

BACKGROUND OF THE INVENTION

Flat mail pieces such as letters are typically sorted by means of pinch belt sorting machines wherein a continuously moving stream of mail pieces is transported along a sorting path by means of pinch belts that hold and transport the mail pieces in the stream. Mail pieces are then selectively diverted into bins or pockets of a sorting case by a series of computer controlled gates. The pockets are then swept, i.e., mail is removed by a human operator and grouped for further processing.

Items such as mail (presorted or not), being shipped internationally are aggregated according to size, weight and destination and sent to a shipping receiver in or near the destination country. The receiver then makes the final delivery to the end address. Usually the receiver is chosen based upon pricing and level of service such as priority vs. economy. A service that is provided by an international mail exchange facility is to aggregate items from multiple sources and prepare them for shipment in the most economical manner according to the shipping receiver, level of service and ultimate destination.

Examples of items that are shipped in this manner include letters, magazines, mail order goods and various media items such as DVDs and software. In the USA, international mail exchange facilities accept mail from many merchants and prepare groupings of items to send to shipping receivers in countries throughout the world. The aggregation and sorting of these items is complex, in that it is a function of weight, format, service level and destination. Shipping receivers specify the manner of containment for an aggregate of items such as a sack or box. A weight range is also specified that will vary by format and receiver. Because the rates charged by receivers can vary frequently, the sorting algorithm must be adjusted to compensate for rate changes to minimize the shipping cost.

The receiver then makes the final delivery to the end address. Usually the receiver is chosen based upon pricing and level of service such as priority vs. economy. A service that is provided by an international mail exchange facility is to aggregate items from multiple sources and prepare them for shipment in the most economical manner according to the shipping receiver, level of service and ultimate destination.

In the current mail exchange facilities items from a source are taken to an appropriate work cell based upon the characteristics of service class and format. These are typically large groupings of like items on a pallet and referred to as a "job". Within the work cell there are workstations that consist of open face cases often referred to as "pigeon-hole" cases. Each separation within the case is a compartment that is open facing the operator and closed at the back. Each compartment is labeled according to destination and shipping receiver weight range. The operator has a scale and a first piece is weighed and then sorting (done manually) is performed according to the destination and weight range. Occasionally a job such as from a mail order house may consist of items that vary in weight. When this occurs, the operator must weigh each type of item individually and tracking of the weight in a separation is more complex and error prone. A single job may be distributed to multiple workstations within the work cell.

During the sorting operation, the pieces and weight in each separation are tracked by the operator. When an appropriate number of pieces for the weight range specified by the receiver is accumulated in a separation, the operator removes the pieces and places them in a shipping container. The operator writes the number of pieces, destination, receiver, and other relevant data upon the container and closes the container. If the container is a box the operator will cut it down to size to minimize the volume of the container before closing. The container is then sent to a manifesting station where the data for the container is recorded to a database system and a shipping label is printed and applied by a manifesting clerk.

When an operator completes a job there will usually be residue pieces in the case separations that are not sufficient to meet the minimum weight range for a shipping container as specified by the receiver. The operator removes these pieces and takes them to a consolidation area. The operator places the items in consolidation containers and records the relevant data on a form associated with the container such as by a clipboard on a hanger. Operators from other workstations within the work cell bring residue mail to the same consolidation area and, when the items in a consolidation container are sufficient to meet the specified weight range, a shipping container is completed and sent to the manifesting area.

The primary disadvantage of the prior art is inefficiency of labor and resource usage. A worker sorting mail spends over two-thirds of available time doing tasks other than sorting items. These tasks are: getting the job, making up shipping containers, writing down information, taking items to the consolidation area, and so on. While this extraneous activity is being done, the worker is not sorting and the pigeon-hole case is not being used. Because of this, many more workstations and operators are required than in the current invention.

SUMMARY OF THE DISCLOSURE

Various disclosed embodiments include a system, method and apparatus for sorting items for delivery. A smart case module includes a plurality of bins. Each bin includes a display for a sort criteria for the bin and a first indicator to indicate that the bin is active. The bin also includes an input device for an operator to use to indicate that an item has been placed in the bin. The bin further includes a second indicator to indicate that the bin contains a sufficient number of items for a shipping container.

BRIEF DESCRIPTION OF THE DRAWING

In the accompanying drawings, where like numerals denote like elements.

DETAILED DESCRIPTION

Figures 1A, 1B, 1C:
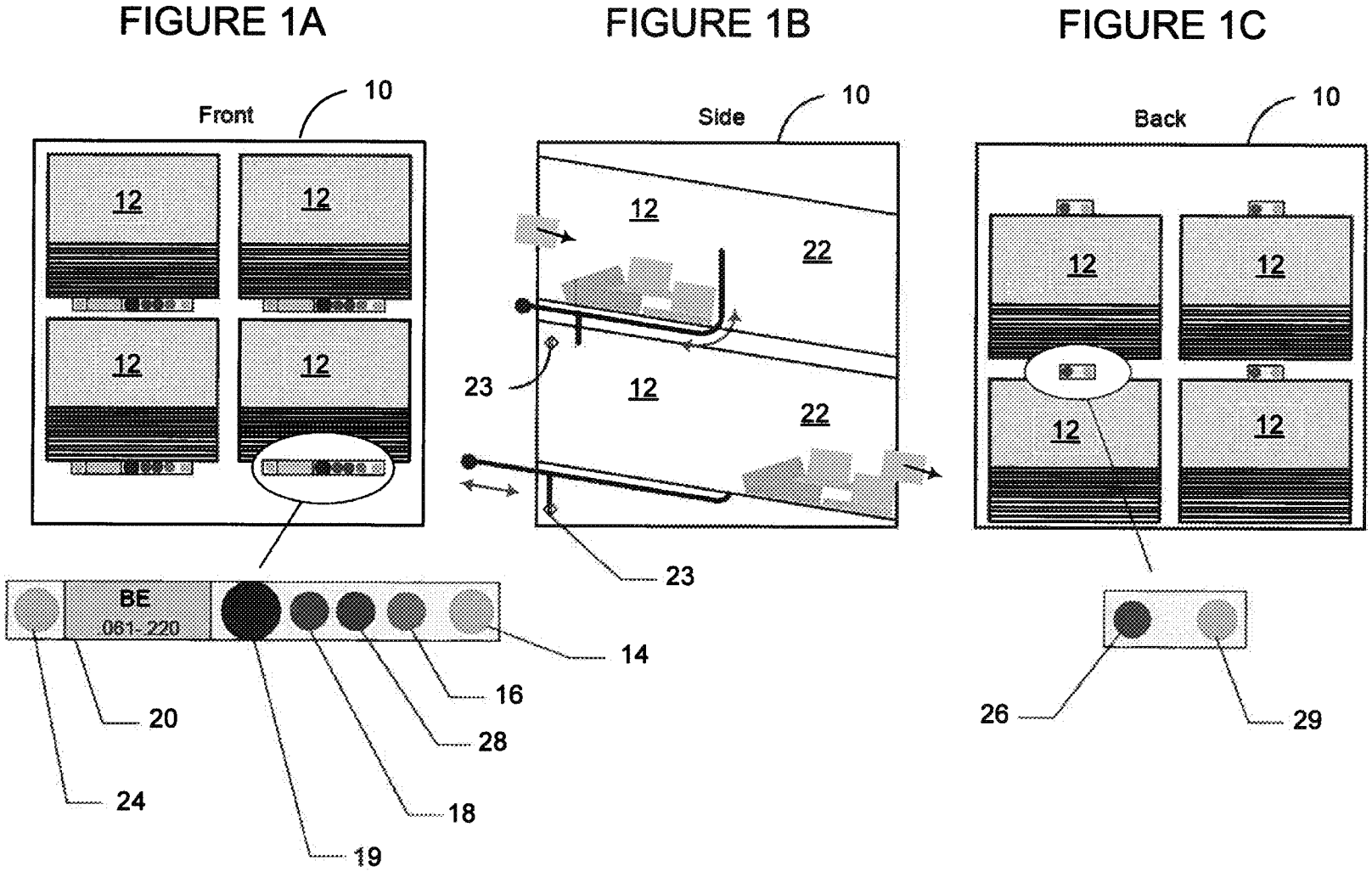
FIGS. 1A, 1B and 1C present front, side and back views, respectively, of a smart case in accordance with an embodiment.

FIGS. 1A, 1B and 1C present front, side and back views, respectively, of a smart case module 10 in accordance with an embodiment with two levels and four separations (bins 12). The number of levels and separations may be varied depending upon the number of separations required and format of the items being sorted. Modules 10 can be combined to achieve the number of required separations in a workstation. The operator indicates to the system the job being worked and the item weight prior to sorting. When a batch of items of the same type is being processed, a single piece may be weighed and subsequent pieces are assumed to be the same weight. An LCD indicator 20 below each bin 12 displays the sort criteria for the bin 12. The operator places an item in the bin 12 according to the sort criteria, presses a button 14 on the right and the system keeps a record of the pieces and weight that has been sorted to each bin 12. A rightmost indicator 16 is activated by the computerized control system to indicate the bin 12 is active and available for sorting.

Still referring to FIG. 1, when a sufficient number of items to complete a shipping container have been sorted to a bin 12, the system activates the leftmost indicator 18. The operator pulls the center knob 19 and the items are released into a second chamber 22 for that bin 12. The operator pushes the knob 19 back and the system senses 23 the movement of the slide 21 from closed to open to closed. The system then extinguishes the indicator 18 in front and lights the indicator 26 on the back panel to direct the sweeper operator to clear the bin 12 from the rear.

If a bin 12 becomes too full for the item being sorted before sufficient weight has been accumulated to complete a shipping container the operator presses pushbutton 24, on the left. The system instructs the operator to dump the bin 12 to the second chamber 22 by flashing the first indicator 16. The system keeps track of subsequent pieces sorted to this chamber 22 and initiates the correct sequence of events to have the sweeper operator consolidate the items from the first group to the second.

When a job has been completed the system will flash the second indicator 28 on the front for all bins 12 that have partial container loads. The operator will then activate the dump knob 20 for each bin 12 to release the items into the second chambers 22. The sweep operator is then instructed to put the items into consolidation tubs by flashing the rear indicator 26 for each bin with a partial load.

Figure 2A:
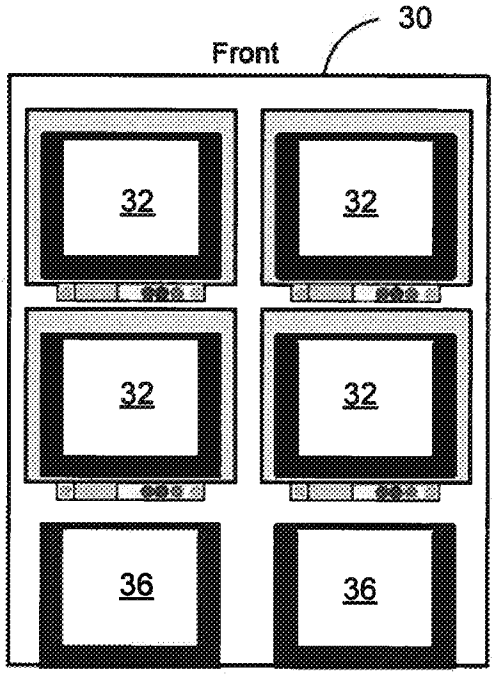
FIGS. 2A, 2B and 2C present front, side and back views, respectively, of a smart case in accordance with another embodiment.
Figure 2B:
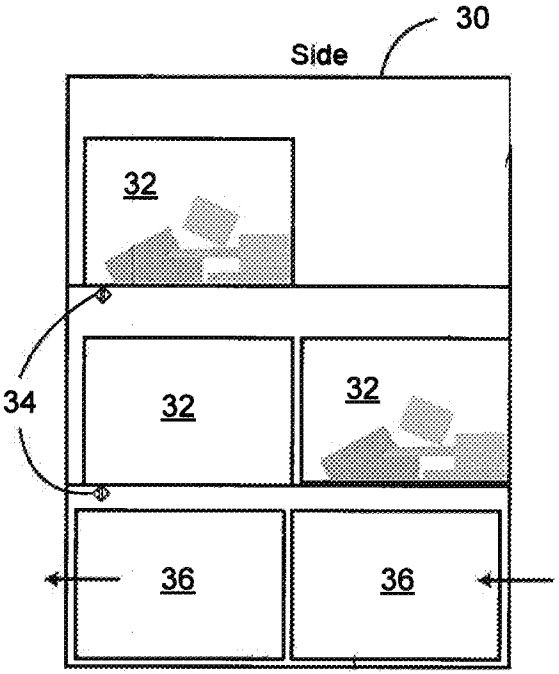
Figure 2C:
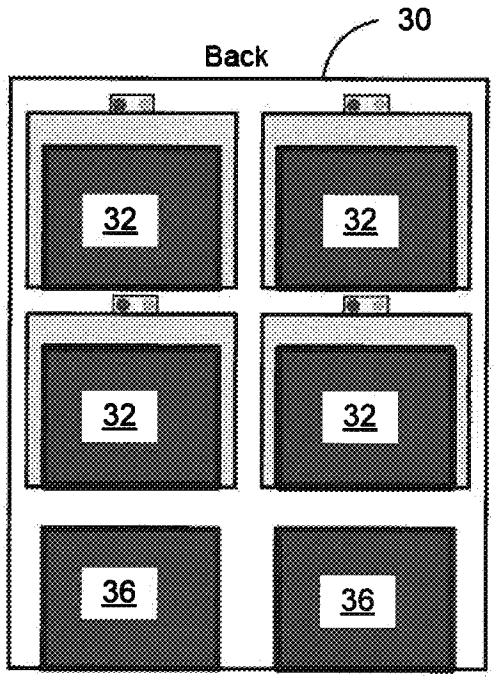

FIGS. 2A, 2B and 2C present front, side and back views, respectively, of a smart case 30 in accordance with an embodiment. The smart case 30 uses sort containers 32 to move the sorted items from the front to the back of the case. This case operates the same as described for the system shown in FIG. 1 with the exception that sort containers 32 with open fronts are placed in the front bins and pushed to the rear when filled. The system senses 34 the movement of the sort container 32 to assure synchronization of the indicators with the location of the sort container. The sweeper removes the sort container 32 and moves the contents to either a shipping container or consolidation tub and the empty sort container 36 is returned to the sort operator on the bottom shelf of the case 30.

Figure 3:
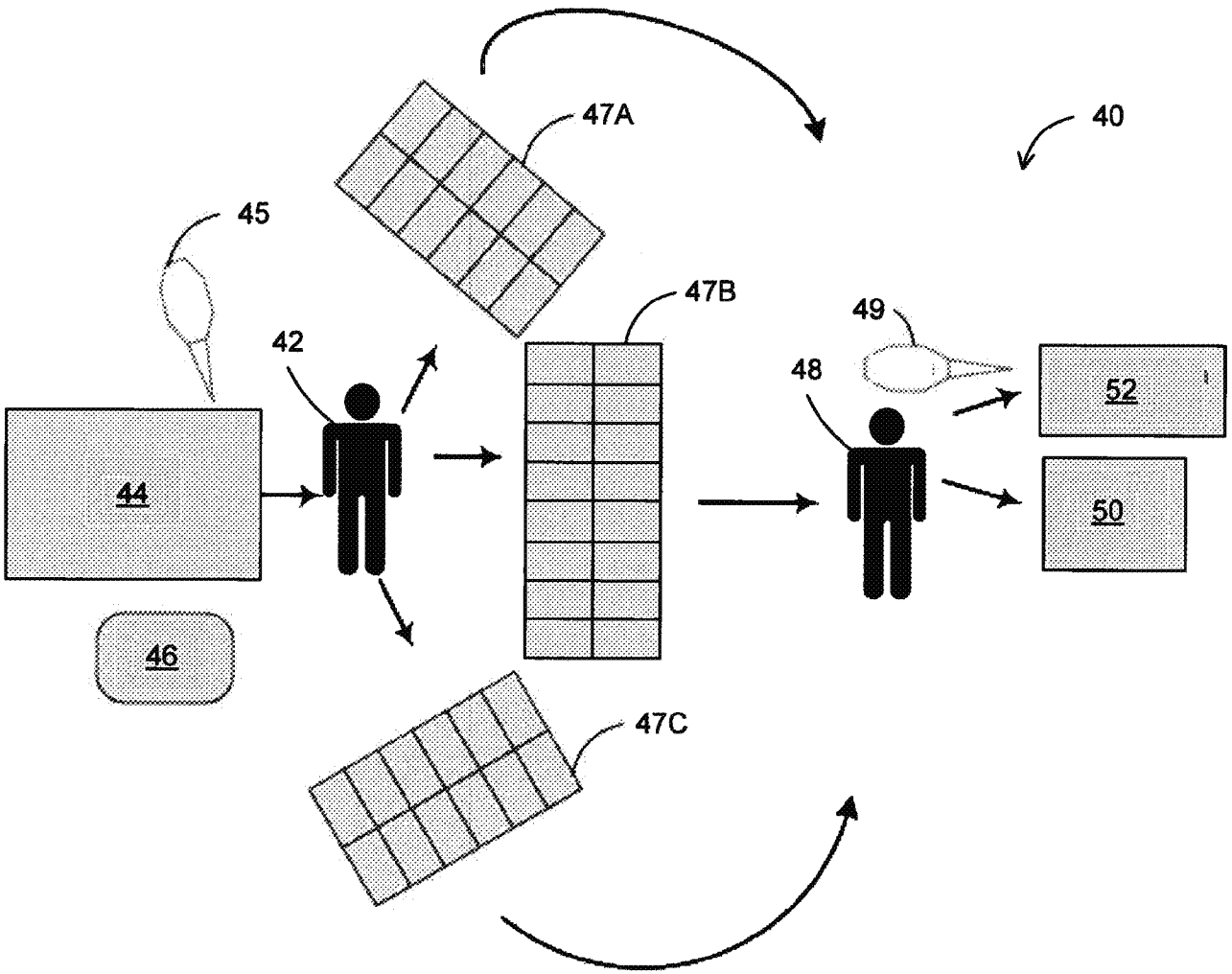
FIG. 3 is a schematic diagram of a 40 separation work station in accordance with an embodiment.

FIG. 3 depicts a workstation 40 with two levels and forty sort separations. The sort operator 42 logs into the job 44 by scanning 45 a bar code on the job paperwork. For like items the first piece is weighed and for unlike items each piece is weighed on a scale 46 with a system interface. The sort operator 42 works from the center of the station to pick up items from the job 44 and place in the cases 47A, 47B and 47C according to the destination data on the item and sort data on the bin display. The sweep operator 48 removes the items from the back side of the cases 47A, 47B and 47C and dispositions the items as described above. If the items are placed in a consolidation container 52 the sweep operator may scan 49 a barcode identifier on the container 52 that is unique to that container 52 if the consolidation area is remotely located. The workstation 40 also includes a shipping container 50.

Figure 4:
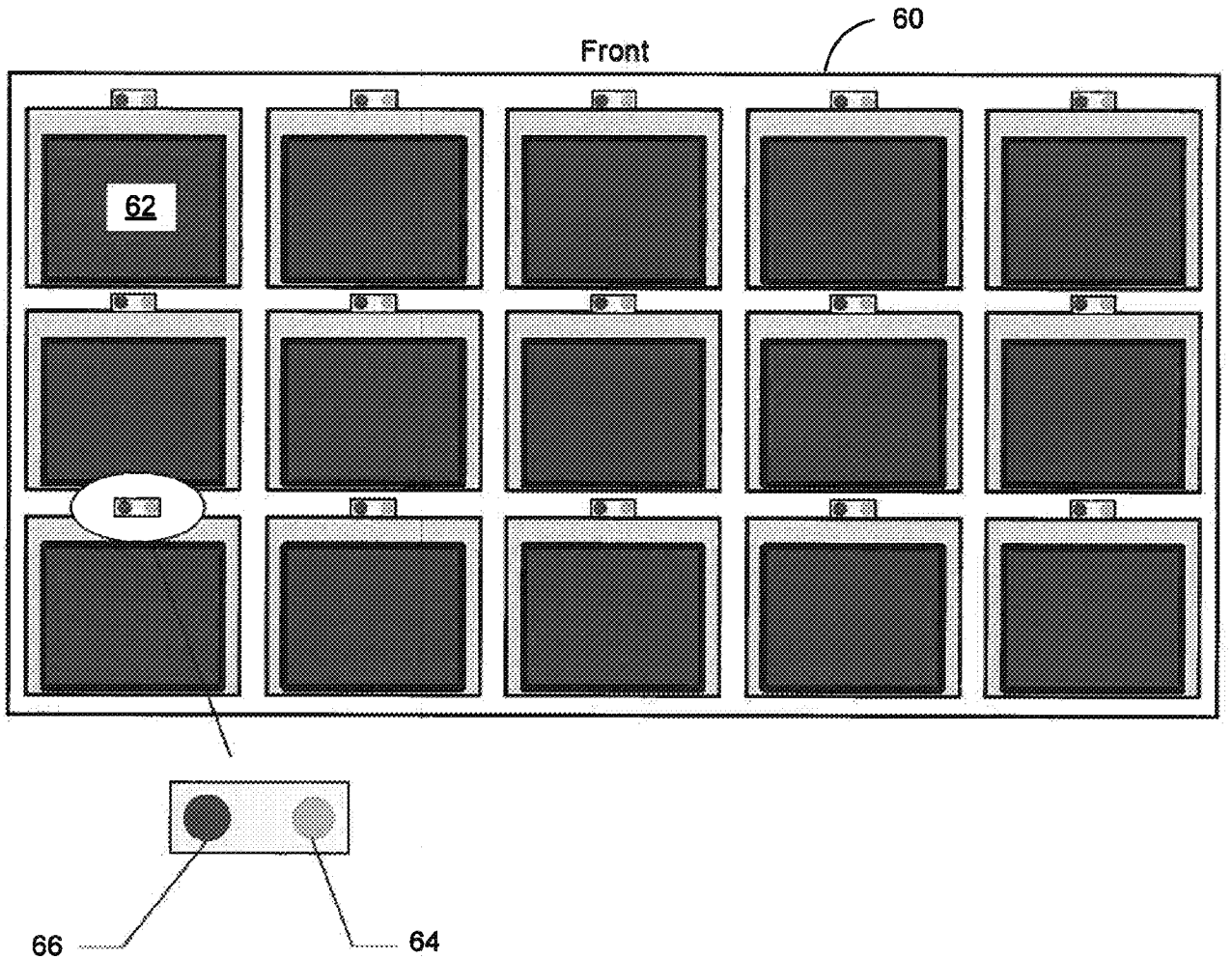
FIG. 4 is a view of a consolidation case in accordance with an embodiment.

FIG. 4 is a consolidation case 60 in accordance with an embodiment. When the sweep operator removes a group of items from the smart case that are insufficient by themselves to make a complete shipping container, the sweep operator places the items in a consolidation container 62. Once the sweep operator has removed the items and pressed the pushbutton 29 (see FIG. 1), indicating the bin has been swept, the system lights an indicator 66 on the consolidation case 60. If the indicator 66 is illuminated continuously, the operator places the container 52 (see FIG. 3) in the compartment corresponding to the indicator 66, or combines the contents of the container 52 with a container 62 that was previously placed in the compartment. If the indicator 66 is flashing, the operator removes a previously placed container 62 from the indicated compartment and combines it with the current consolidation container 52 items to form a completed shipping container 50 (see FIG. 3). In either situation, the operator presses the corresponding pushbutton 64 to indicate to the system the action has been completed.

In some embodiments the consolidation case 60 may be located remotely from the casing area 40 (see FIG. 3). In this configuration, the sweep operator will put a partial load of items in a consolidation container 52 and scan a barcode on the container 52. The container 52 is then transferred to the consolidation area and a consolidation operator will scan the container to re-identify it. The system will then indicate the case location and action to be taken as described above.

Figure 5:
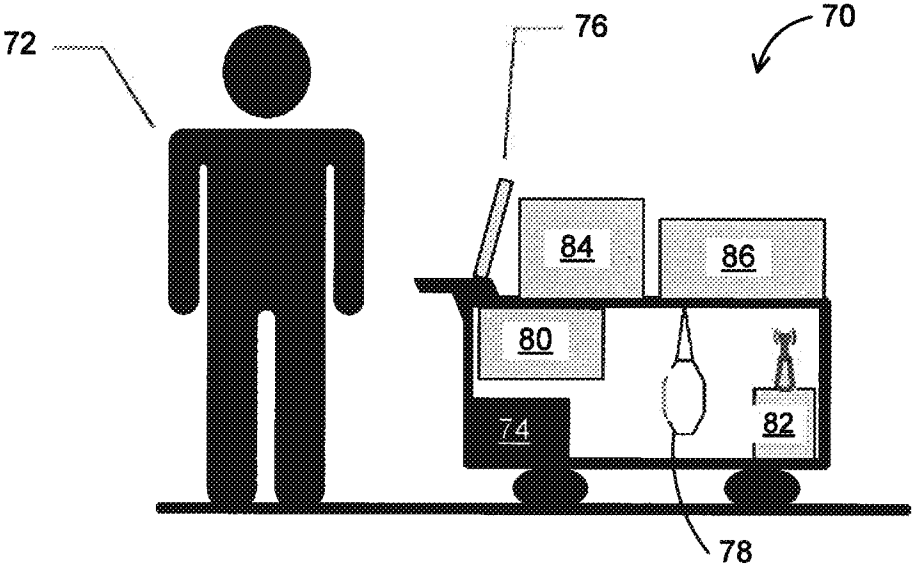
FIG. 5 is a side view of a sweeper cart in accordance with an embodiment.
Figure 11:
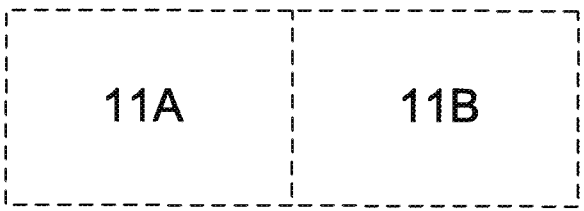
FIGS. 11A and 11B are a schematic block diagram of a smart case system including conveyor material handling features in accordance with an embodiment.

FIG. 5 shows the cart 70 that the sweep operator 72 uses when picking up the output groups of items from the cases. This cart 70 has a power source 74 such as a storage battery to power the electronics on-board. The human machine interface (HMI) 76 is a common electronics commodity item with a small LCD display and input capability such as a touch screen. A bar code reader 78 that can be either hand-held or fixed-mount is included to scan consolidation containers if necessary. When a container is finished, the label printer 80 prints a label. A controller 82, such as a PC, is connected to the HMI 76, barcode reader 78 and printer 80, and is interfaced wirelessly to the workstation controller. The cart 70 also includes a shipping container 84 and a consolidation tub 86.

Figure 6:
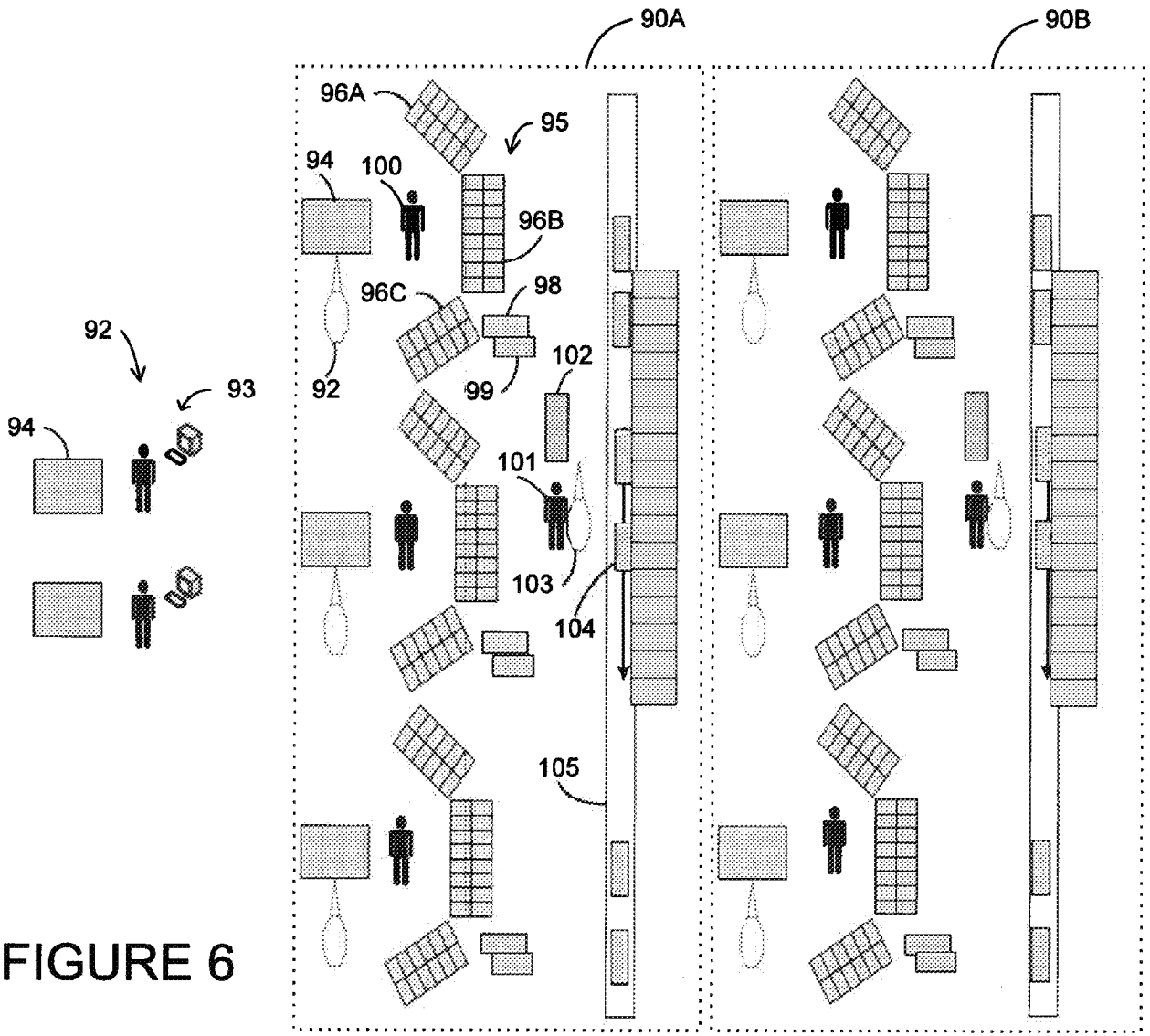
FIG. 6 is an overhead view of two work cell areas in accordance with an embodiment.

In FIG. 6, two work cells 90A and 90B with three workstations 95 each are shown in accordance with an embodiment. A work station 95, as described with reference to the work station 40 of FIG. 3, includes a bar code scanner 97, cases 96A, 96B and 96C, and a sort operator 100. The work station 95 further includes a customer job pallet 94, a box 98, and a bag 99. In the prep area, a document with an identifying barcode is created for each job. The prep area 93 includes two prep stations 93, each having a customer job pallet 94. The job is moved to a workstation 95 and the sorter operator 100 scans 92 this barcode to log in to the job. The sorter 100 sorts the mail as described for FIG. 3 and the sweeper 101 removes the mail from the back of the case when instructed.

As the sweeper 101 removes items from the cases 96A, 96B and 96C and presses the corresponding button 29 (see, FIG. 1) on the back of the case 96A, 96B or 96C. The cart 102 HMI display indicates the disposition of the items such as: "put in a sack" or "box for shipment." The shipping label is printed and the sweeper completes the shipping container 104 by labeling, closing and placing on the takeaway conveyor 105.

Figure 7:
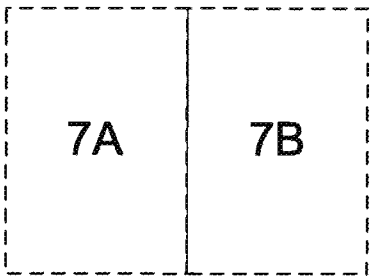
FIGS. 7A and 7B is an overhead view of a smart case system including conveyor material handling features in accordance with an embodiment.
Figure 7A:
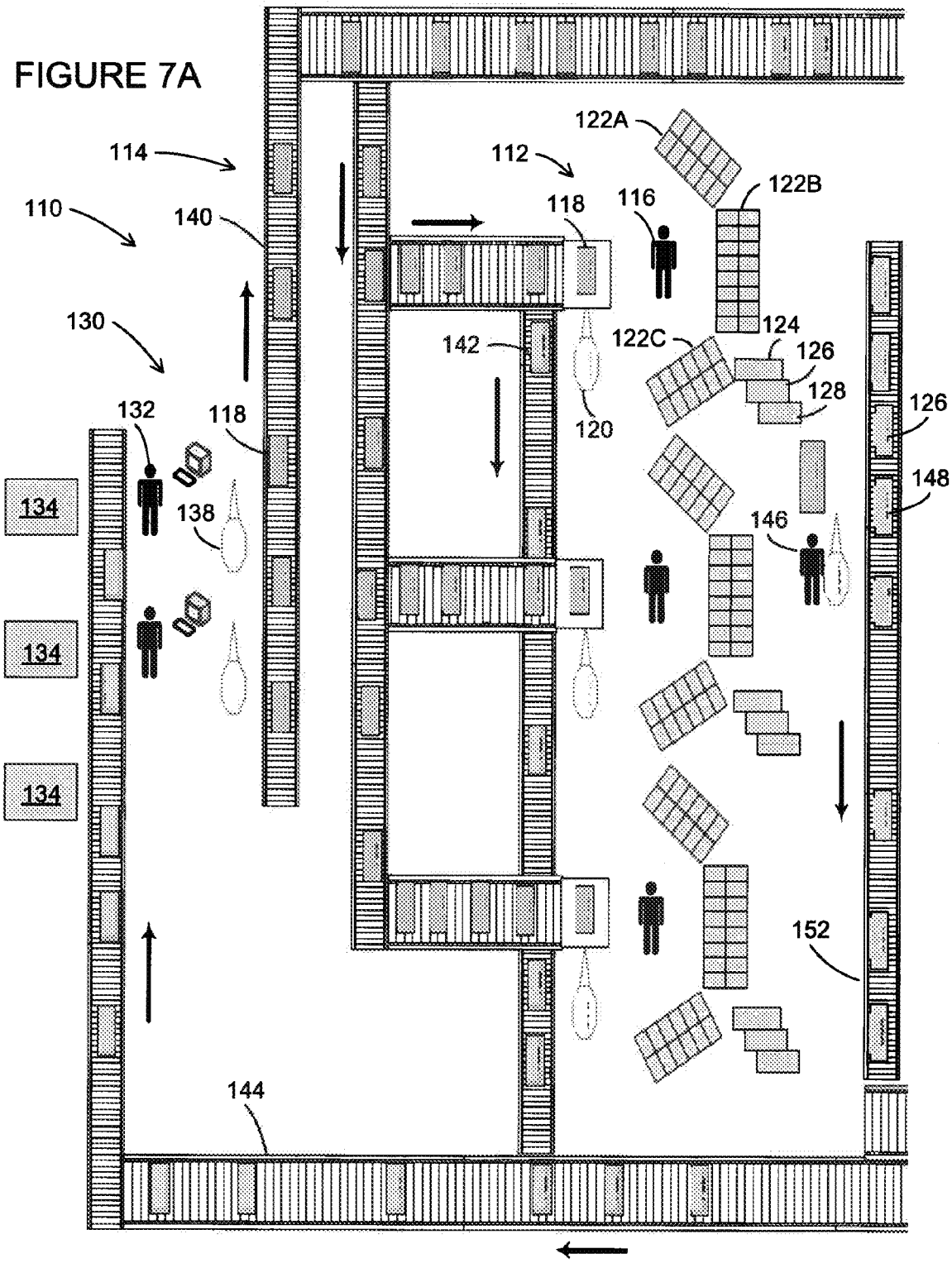
Figure 7B:
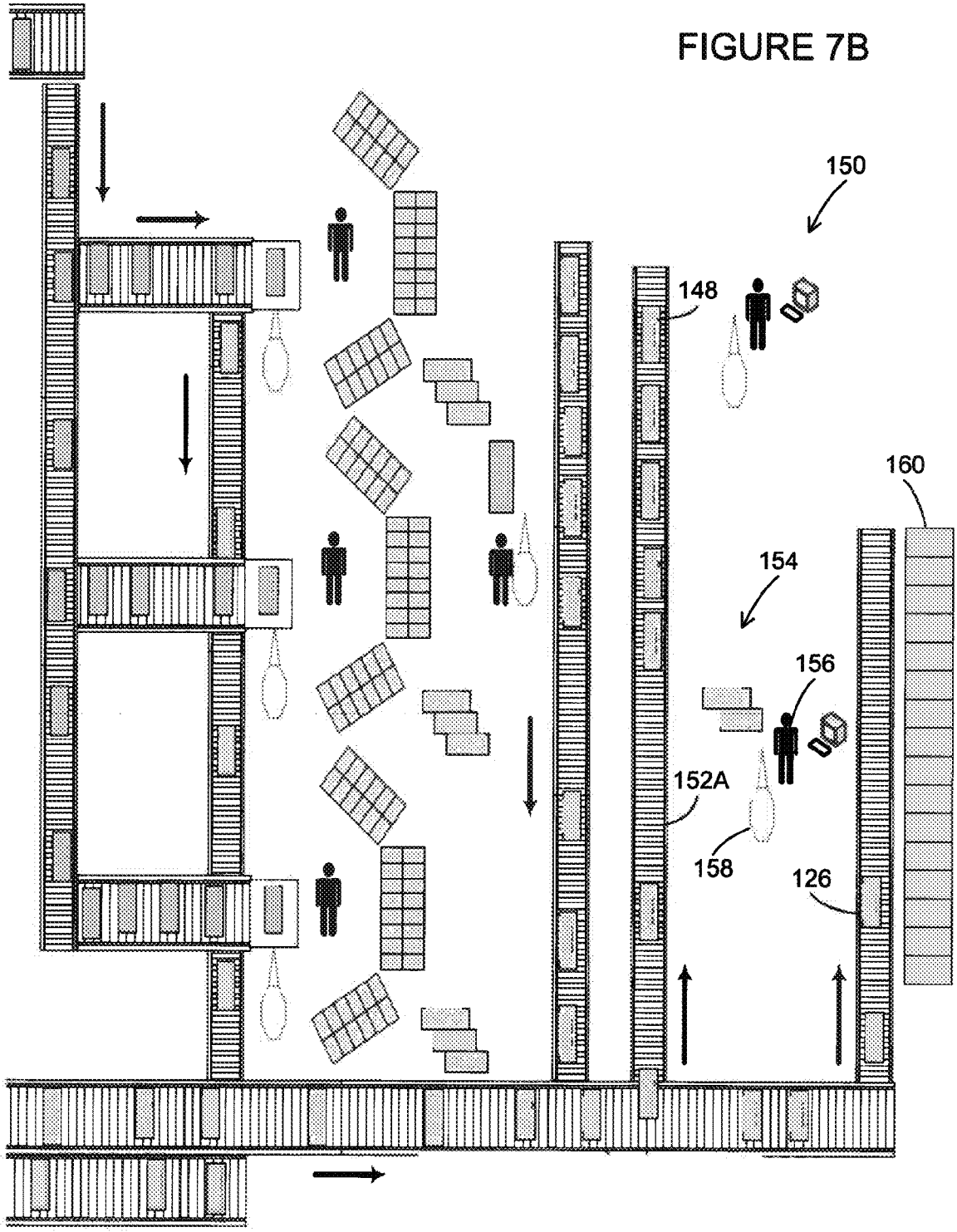

FIGS. 7A and 7B present an overhead view of a smart case system 110 in accordance with the disclosure. The system 110 includes six workstations 112 and a material handling system 114 built with a powered conveyor such as a roller conveyor. The material handling system 114 tracks the individual items being conveyed and can selectively divert items down a branch circuit. The workstation 112, as described with reference to the workstation 40 of FIG. 3 and the workstation 95 of FIG. 6, includes a bar code scanner 120, cases 122A, 122B and 122C, a box 124, and a bag 128. The workstation 112 further includes a tub 118 and a consolidation container 126.

In the prep area 130 of FIG. 7, an operator 132 logs into the customer job 134 and move the items to be shipped into tubs 118. Each tub 118 has a unique barcode, which the operator scans 138. The system associates the tub 118 with the customer job 134, and when the tub input distribution conveyor 140 delivers the tub 118 to the sorter operator 116 the barcode is automatically read 120. As the sort operator 116 sorts the item and pushes the button on the case 122A, 122B or 122C the system associates the item with the customer job 134. When the sorter operator 116 has emptied a tub 118, the empty tub 142 is placed on the empty tub return conveyor 144 and recirculated to the prep area 130.

In the system of FIG. 7, the sweeper operator 146 fills and applies the label to finished shipping containers 148 as in the system of FIG. 6 but does not close and cut down the container for shipping. The open but full containers 148 are routed to the close and scan area 150 where the label is scanned and the container is prepared for shipping by cutting down and taping.

The sweeper operator 146 scans consolidation containers 126 and places them on the sorted mail conveyor 152. The system correlates the scanned consolidation container 126 with the mail that was placed in it during the case transfer. The consolidation container 126 is routed to the consolidation area 154 where an operator 156 scans 158 the container 126 and the system instructs the operator 156 how to disposition the container 126 and items by activating the appropriate indicator 66 (see FIG. 4) on the consolidation case 160.

If the system determines sufficient mail has accumulated for a given consolidation point, the corresponding indicator 66 will be flashed and the consolidation operator 156 will be instructed by a local monitor how to prepare the shipment—in this example, place in a sack or box. The system prints out the label and the operator 156 places the container 148 on the conveyor line 152A to the close and scan area 150.

Figure 8:
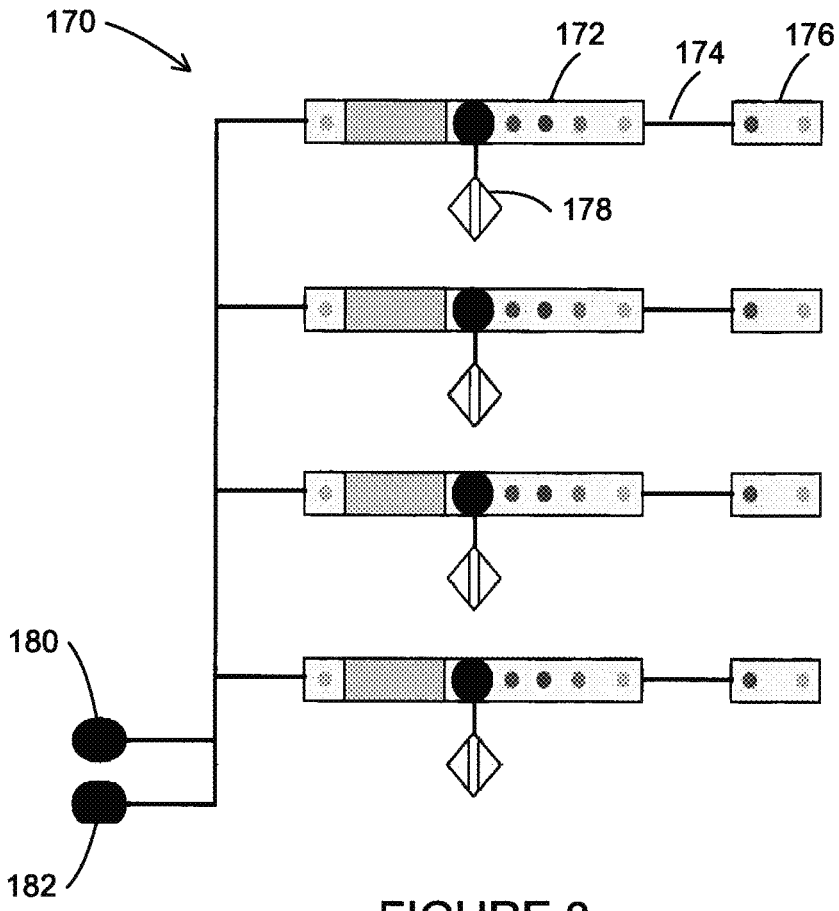
FIG. 8 is a diagram of 4 bin case module wiring in accordance with an embodiment.

FIG. 8 shows a diagram of the wiring 170 for a four bin case module in accordance with an embodiment. The display, indicators and pushbuttons for a sorting bin (as described with reference to FIGS. 1 and 2) are mounted on a printed circuit board (PCB) 172 with a serial interface such as RS-485 multidrop or CAN bus. The PCB 172 connects to a cable 174 to a panel assembly 176 for the pushbutton and indicator on the back side of the case. The slide sensor 178 is also connected to the PCB 172. A PCB 172, panel assembly 176, and slide sensor 178 are provided for each sorting bin in the case. Each of the PCBs 172 is also connected to a power connector 180 and a serial connector 182.

Figure 9:
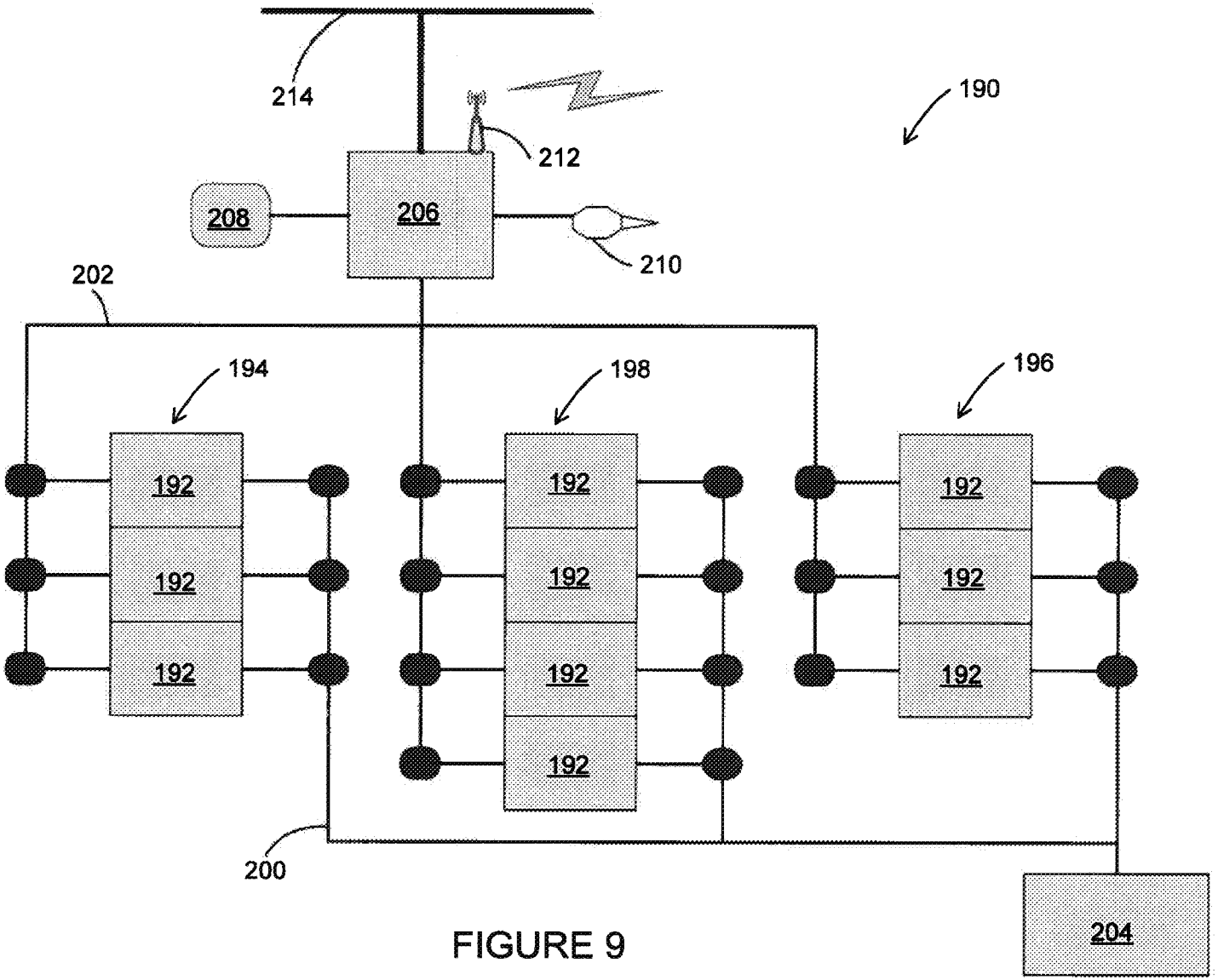
FIG. 9 is a diagram of a 40 bin work station wiring in accordance with an embodiment.

FIG. 9 is a diagram of a forty bin work station wiring 190 in accordance with an embodiment. The forty bin work station includes ten four bin case modules 192. As shown in FIG. 3, the ten modules are arranged in two groups 194 and 196 of three modules (twelve bins) each on each side of a group 198 of four modules (sixteen bins). The modules in each of the groups 194, 196 and 198 are connected together for power 200 and serial 202 interface. The power lines 200 are connected to a power supply 204 and the serial lines 202 connect to the workstation controller 206.

A scale 208 and barcode scanner 210 connect to the workstation controller 206. The workstation controller 206 also has a wireless interface 212 to the sweep cart that is designated for this workstation. The workstation controller 206 interfaces to the overall system controller via system control interface 214 for sort plans, statistical data transfer and other functions such as status reporting.

Figure 10:
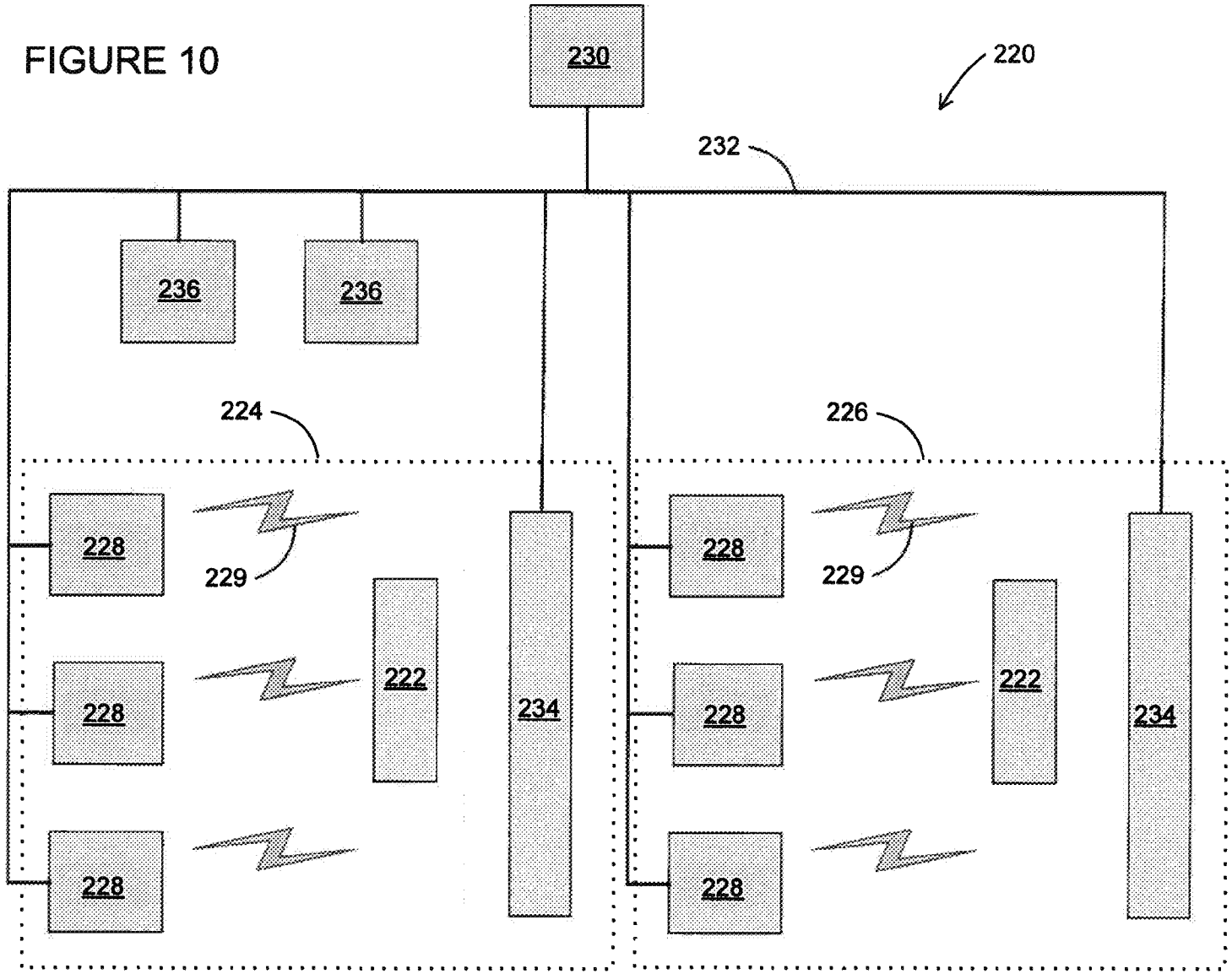
FIG. 10 is a schematic block diagram of two work cell smart areas in accordance with an embodiment.

FIG. 10 is a block diagram 220 of the overall system shown in FIG. 6. One sweeper cart 222 is assigned to each group of three workstations 228 in work cells 224 and 226. Each workstation 228 is in wireless communication 229 with its associated sweeper cart 222. The workstations 228 interface to the system controller 230 via Ethernet 232. The consolidation cases 234 also interface to the system controller 230 and the system controller 230 coordinates the resolution of items to be consolidated by receiving data from the workstations 228 and tracking the items in the consolidation cases 234.

The prep stations 236 interface to the system controller 230 and the customer job order data is created at the prep station and uploaded to the system controller 230.

Figure 11A:
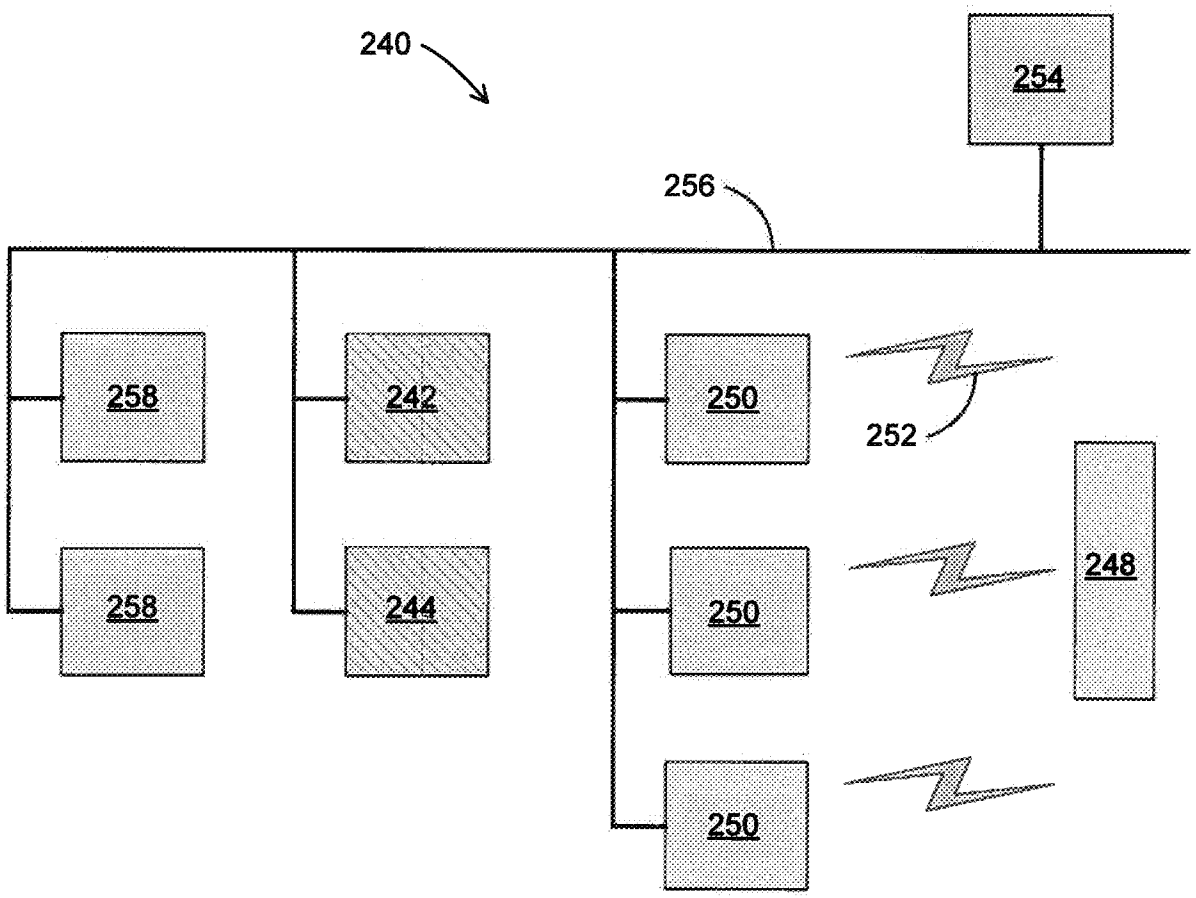
Figure 11B:
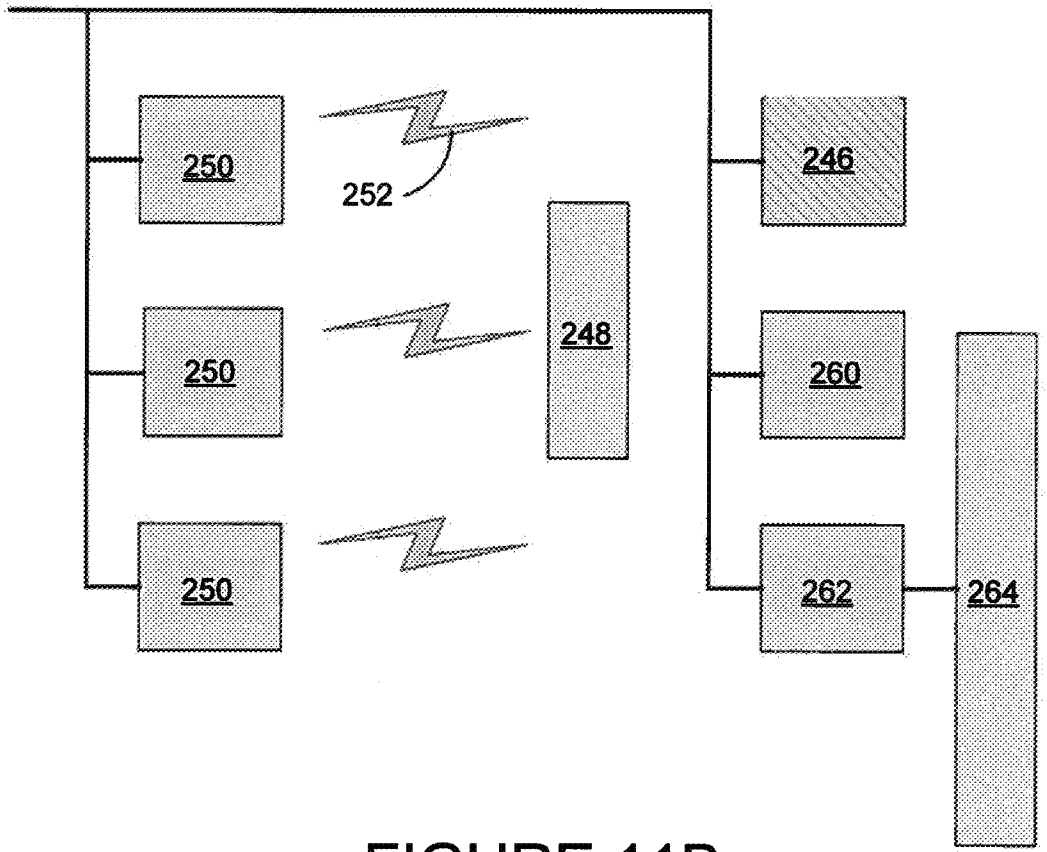

FIGS. 11A and 11B are a block diagram 240 of the overall system shown in FIG. 7. This system 240 includes the conveyor controllers 242, 244 and 246 necessary to automate material handling between the various workstations. The conveyor control is segmented into three areas. The first is the tub input distribution conveyor that conveys tubs full of items to be sorted from the prep stations to workstations. The second conveys tubs that have been emptied in the workstations back to the prep stations. The third conveyor system carries containers with items that have been sorted back to the close and label station or to the consolidation area. The controller 242 controls the tub input distribution conveyor, the controller 244 controls the empty tub return conveyor, and the controller 246 controls the sorted item conveyor.

The system 240 also includes two sweep carts 248, each assigned to a group of three workstations 250. The workstations 250 are in wireless communication 252 with their associated sweeper carts 248. The workstations 250 and the controllers 242, 244 and 246 are in communication with a system controller 254 via a communication link 256. The system 240 also includes two prep stations 258, which are in communication with the system controller 254 via the communication link 256. The system 240 further includes a close and label terminal 260 and a consolidation terminal 262, both of which are also in communication with the system controller 254 via the communication link 256. The consolidation terminal 262 is also in communication with a consolidation case 264.

What is claimed is:

1. A method sorting items for delivery, the method comprising:

providing a plurality of bins, each bin associated with a display, an input device, and a plurality of indicators, at least one of the plurality of bins comprising a first portion and a second portion, wherein the first portion is separated from the second portion by a partition;

displaying a sort criterion for the bin using the associated display;

indicating, using a first indicator associated with the bin, that the bin is active;

receiving items in the first portion of the bin;

receiving, from the associated input device, an indication that an item has been placed in the bin;

indicating, using a second indicator associated with the bin, that the bin contains a sufficient number of items for a shipping container;

providing an actuator for the bin, the actuator coupled to the partition and adapted, when actuated, to cause items in the first portion of the bin to transfer into the second portion of the bin by causing the partition to move from a closed position to an open position;

sensing actuation of the actuator;

indicating, using a third indicator associated with the bin, that the actuator has been actuated; and transferring items to the second portion of the bin.

2. The method of claim 1, further comprising:

when all available items have been sorted, indicating using a third indicator associated with the bin that the items in the first portion of the bin should be transferred from the first portion of the bin to the second portion of the bin;

sensing transfer of the items from the first portion of the bin to the second portion of the bin; and indicating, using a fourth indicator associated with the bin, that the items have been transferred.

3. The method of claim 1, wherein the bin is associated with a second input device, the method further comprising:

receiving, from the second input device, an indication that the first portion of the bin is full of items;

indicating, using the first indicator, that the items in the first portion of the bin should be transferred from the first portion to the second portion of the bin;

receiving additional items in the first portion of the bin; and causing consolidation of the items in the second portion of the bin with the additional items in the first portion of the bin.

4. The method of claim 1, wherein the bin is associated with a second input device, the method further comprising:

providing a plurality of consolidation containers, each consolidation container associated with a third input device and a third indicator;

removing items from the bin, where the items are not a sufficient number of items for a shipping container;

receiving, from the second input device, an indication that the items have been removed from the bin;

indicating, using one of the plurality of third indicators, that the items removed from the bin should be placed in the consolidation container associated with the one of the plurality of third indicators;

receiving, from a third input device associated with the consolidation container, an indication that the items have been placed in the associated consolidation container.

5. The method of claim 4, further comprising:

indicating, using one of the plurality of third indicators, that the items removed from the bin should be combined with additional items in the consolidation container associated with the one of the plurality of third indicators and placed in a shipping container; and receiving, from the third input device associated with the consolidation container, an indication that the items removed from the bin have been combined with the additional items in the associated consolidation container and placed in the shipping container.

6. A sorting case, comprising:

a plurality of bins, each bin associated with a display, an input device, and a plurality of indicators, wherein for at least one of the plurality of bins:

the bin comprises a first portion and a second portion, wherein the first portion is separated from the second portion by a partition, wherein the bin is adapted to receive items in the first portion of the bin and transfer items from the first portion of the bin to the second portion of the bin;

the associated display is adapted to display a sort criterion;

a first associated indicator is adapted to indicate that the bin is active;

the associated input device is adapted to provide an indication that an item has been placed in the bin;

a second associated indicator is adapted to indicate that the bin contains a sufficient number of items for a shipping container;

an actuator coupled to the partition is adapted, when actuated, to cause items in the first portion of the bin to transfer into the second portion of the bin by causing the partition to move from a closed position to an open position;

a sensor is adapted to sense actuation of the actuator; and a third associated indicator is adapted to indicate that the actuator has been actuated.

7. The sorting case of claim 6, wherein the at least one bin comprises:

a sensor adapted to sense transfer of the items from the first portion to the second portion of the bin; and a third indicator associated with the bin, the third indicator adapted to indicate that the items have been transferred.

8. The sorting case of claim 6, wherein the at least one bin further comprises:

a third indicator associated with the bin, the third indicator adapted to indicate, when all available items have been sorted, that the items in the first portion of the bin should be transferred from the first portion of the bin to the second portion of the bin;

a sensor adapted to sense transfer of the items from the first portion of the bin to the second portion of the bin; and a fourth indicator associated with the bin, the fourth indicator adapted to indicate that the items have been transferred.

9. A system for sorting items for delivery, the system comprising:

a plurality of sorting cases, each sorting case comprising a plurality of bins, each bin associated with a display, an input device, and a plurality of indicators;

wherein at least one of the plurality of bins comprises:

a first portion and a second portion, wherein the first portion is separated from the second portion by a partition;

an actuator coupled to the partition and adapted, when actuated, to cause items in the first portion of the bin to transfer into the second portion of the bin by causing the partition to move from a closed position to an open position; and a sensor adapted to sense actuation of the actuator;

wherein the bin is adapted to:

receive items in the first portion of the bin; and transfer items from the first portion of the bin to the second portion of the bin; and a system controller adapted to:

display a sort criterion for a bin on the display associated with the bin;

indicate, using a first indicator associated with the bin, that the bin is active;

receive, from the input device associated with the bin, an indication that an item has been placed in the bin;

indicate using a second indicator associated with the bin that the bin contains a sufficient number of items for a shipping container;

receive, from the sensor, an indication that the actuator has been actuated; and indicate, using a third indicator associated with the bin, that the actuator has been actuated.

10. The system of claim 9, wherein:

the bin further comprises a first sensor adapted to sense transfer of the items from the first portion of the bin to the second portion of the bin; and the system controller is further adapted to:

indicate, using a third indicator associated with the bin, when all available items have been sorted, that the items in the first portion of the bin should be transferred from the first portion of the bin to the second portion of the bin;

receive, from the sensor, an indication that the items have been transferred to the second portion of the bin; and indicate, using a fourth indicator associated with the bin, that the items have been transferred.

11. The system of claim 9, wherein:

the bin further comprises a second input device; and the system controller is further adapted to:

receive, from the second input device, an indication that the first portion of the bin is full of items;

indicate, using the first indicator, that the items in the first portion of the bin should be transferred from the first portion to the second portion of the bin; and instruct an operator to consolidate the items in the second portion of the bin with additional items placed in the first portion of the bin.

12. The system of claim 9, further comprising a consolidation case comprising a plurality of consolidation containers, wherein:

the bin is associated with a second input device and a third indicator;

each consolidation container is associated with a third input device and a fourth indicator; and the system controller is further adapted to:

indicate, using the third indicator, that the items in the bin should be removed;

receive, from the second input device, an indication that the items have been removed from the bin;

indicate, using one of the plurality of fourth indicators, that the items removed from the bin should be placed in the consolidation container associated with the fourth indicator;

receive, from a third input device associated with the consolidation container, an indication that the items have been placed in the consolidation container.

13. The system of claim 12, wherein the system controller is further adapted to:

indicate, using the fourth indicator, that the items removed from the bin should be combined with additional items in the consolidation container and placed in a shipping container; and receive, from the third input device, an indication that the items removed from the bin have been combined with the additional items in the consolidation container and placed in the shipping container.

14. The system of claim 12, further comprising a material handling system, wherein the system controller is further adapted to convey an item from a sorting case to a consolidation case using the material handling system.

* * * * *